United States Patent [19]

Nagel, Jr.

[11] Patent Number: 4,723,677

[45] Date of Patent: Feb. 9, 1988

[54] CONTAINER CAP WITH CONNECTOR TABS

[76] Inventor: James H. Nagel, Jr., 7131 Cambria Cir., Orange, Calif. 92669

[21] Appl. No.: 887,512

[22] Filed: Jul. 21, 1986

[51] Int. Cl.[4] ..... B65D 41/04

[52] U.S. Cl. ..... 215/330; 215/329; 215/334; 215/216

[58] Field of Search ..... 215/329, 334, 332, 330, 215/216, 217, 222; 220/296

[56] References Cited

U.S. PATENT DOCUMENTS

| | | | |
|---|---|---|---|
| 1,556,020 | 10/1925 | Noll | 215/332 |
| 3,232,470 | 2/1966 | Gibson . | |
| 3,658,203 | 4/1972 | Richards . | |
| 3,776,406 | 12/1973 | Milbourne, Sr. . | |
| 4,494,665 | 1/1985 | Lehmann | 215/330 |
| 4,546,892 | 10/1985 | Couput | 215/252 |

FOREIGN PATENT DOCUMENTS

| | | | |
|---|---|---|---|
| 130973 | 2/1951 | Sweden | 215/329 |

*Primary Examiner*—Donald F. Norton
*Attorney, Agent, or Firm*—King and Schickli

[57] ABSTRACT

A container cap and a method for forming a container cap with a skirt portion that attaches to the container are provided. The cap has depending tabs attached by a living hinge to the skirt portion. Threads are provided as connectors for mating engagement with the container. The hinged tabs are folded through at least 180° to be received in cavities in the skirt portion. The cavities have converging sidewalls mating with converging edges to snap lock the tabs in the operative position. A lug may be provided on the threads to lock the cap on the container. The method includes the steps of forming the cap with hinged depending tabs, removing the core mold from the cap interior, flexing the tabs inwardly to allow the cap to drop out of the cavity mold, folding the tabs into the skirt portion and snap locking the tabs into the cavities.

12 Claims, 6 Drawing Figures

Fig. 2
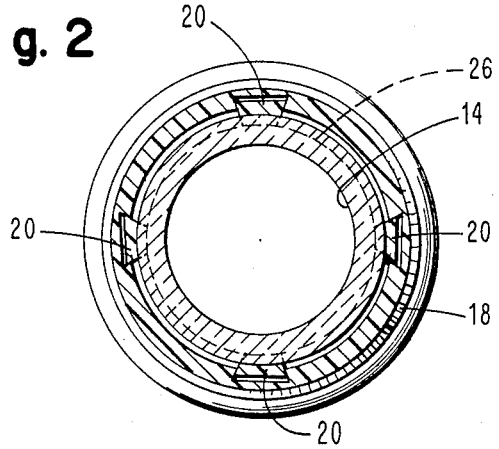
Fig. 2a
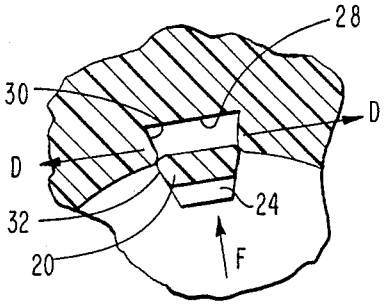
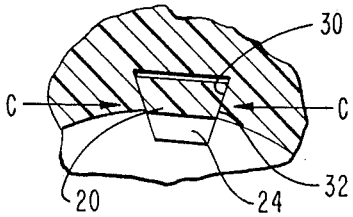
Fig. 2b
Fig. 3
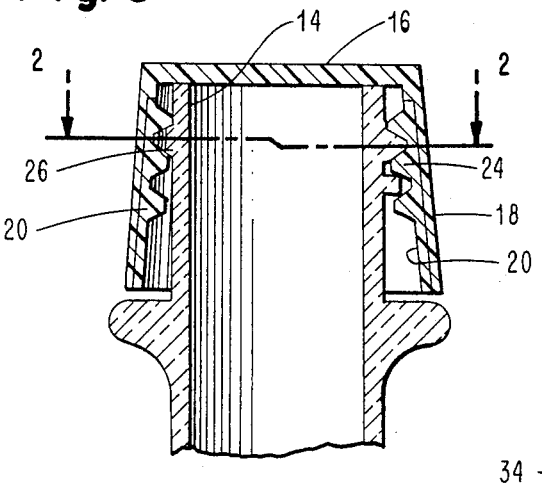
Fig. 4
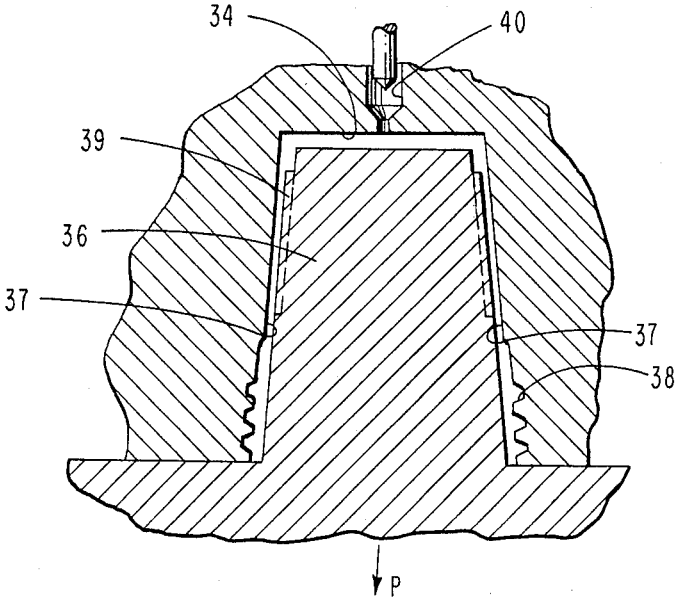

CONTAINER CAP WITH CONNECTOR TABS

BACKGROUND OF THE INVENTION

The present invention relates to a cap for containers, and more particularly, to a molded plastic cap with an improved container connector, and a method of production of the cap.

Caps that connect to a container for sealing the contents are well-known in the art. The caps may be connected to the containers by screw-on threads, snap-on beads, or other similar mechanical means. The caps in the most preferred prior art form have a skirt portion that utilizes internal threads for engaging mating external threads on the neck of the container. Presently, the threads (or other connector means) are integrally formed on the interior of the skirt when the cap is molded of plastic. An example of such threads is disclosed in U.S. Pat. No. 3,232,470 to Gibson.

As will be evident, when the threads, beads or other connecting mechanism are so formed, the internal core mold becomes engaged with the formed cap. Thus the mold must be removed by either disassembling the mold to release the engaged portion from the cap or, in the case of threaded connections, the core mold can be unscrewed from the interior of the cap. In either event, removing the core mold in this manner increases the time and labor required for manufacturing the container cap.

SUMMARY OF THE INVENTION

Accordingly, it is a primary object of the invention to provide an improved container cap that overcomes the above-described limitations and disadvantages.

Another object of the invention is to provide a container cap that is more economical to produce.

Another object of the invention is to provide a molded container cap that can be easily removed from the mold without unscrewing a threaded core or pulling undercuts.

A further object of the invention is to provide an improved method for more economically and efficiently forming a container cap.

Additional objects, advantages, and other novel features of the invention and method will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved container cap is provided. The cap includes a top portion and a skirt portion which may be releasably attached to a container. Hinged tabs are integrally formed with the skirt portion. The hinged tabs carry the connecting means, preferably threads, for engaging with mated connectors on the container. The skirt portion has cavities for receiving the hinged tabs.

In one aspect of the invention, the cavities in the skirt portion are substantially the same size and shape as the hinged tabs so as to receive said tabs when pivoted into place. Since the tabs pivot through 180°, the inside surfaces of both the cavity and the tabs are smooth. The remainder of the internal surface of the skirt is also smooth permitting easy removal of the core mold.

The cavities have converging sidewalls and the hinged tabs have correspondingly converging edges to allow snapping into position with the threads facing the inside of the cap.

In another aspect of the invention, a living hinge provides the permanent attachment between the depending tabs and the lower edge of the skirt. The hinge is formed integrally with the cap during the plastic injection molding process further increasing the economy of the operation. The spring memory in the hinge continuously biases the tabs inwardly of the caps assuring a snug fit of the mating converging sidewalls of the cavity and the edges of tabs. As the cap is screwed on the container full engagement of the mating threads is assured. If necessary, one or more of the tabs may flex toward its mating cavity, to assure smooth screwing and unscrewing of the cap.

According to another aspect of the invention, the molded threads on one of the tabs may include an interference locking lug. This feature prevents unscrewing of the cap unless pressure is exerted on opposite sides of the cap to release the lug.

In a further aspect of the invention, in accordance with its objects and purposes, a method for forming a container cap is provided wherein the first step is forming a cap with integral hinged tabs. Since the internal surfaces are all smooth, the mold core can be easily withdrawn. Secondly, the outwardly facing tabs may be flexed inwardly at the living hinge to provide easy release from the cavity mold. This allows the cap to drop freely from the mold greatly enhancing the cap forming operation.

The cap is completed by simply pivoting or folding the hinged tabs into the corresponding cavities of the skirt portion of the cap.

The hinged tabs are snap locked into operative position in the cavities of the skirt portion by means of the converging sidewalls of the cavities.

Still other objects of the present invention will become readily apparent to those skilled in the art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTON OF THE DRAWINGS

The accompanying drawings incorporated in and forming a part of the specification, illustrate several aspects of the present invention and together with the description serve to explain the principles of the invention. In the drawings:

FIG. 2 is an enlarged cross-sectional view taken along line 2—2 of FIG. 3 and showing the cap attached to the container with all of the tabs in position and the threads fully engaged;

Figure 1:
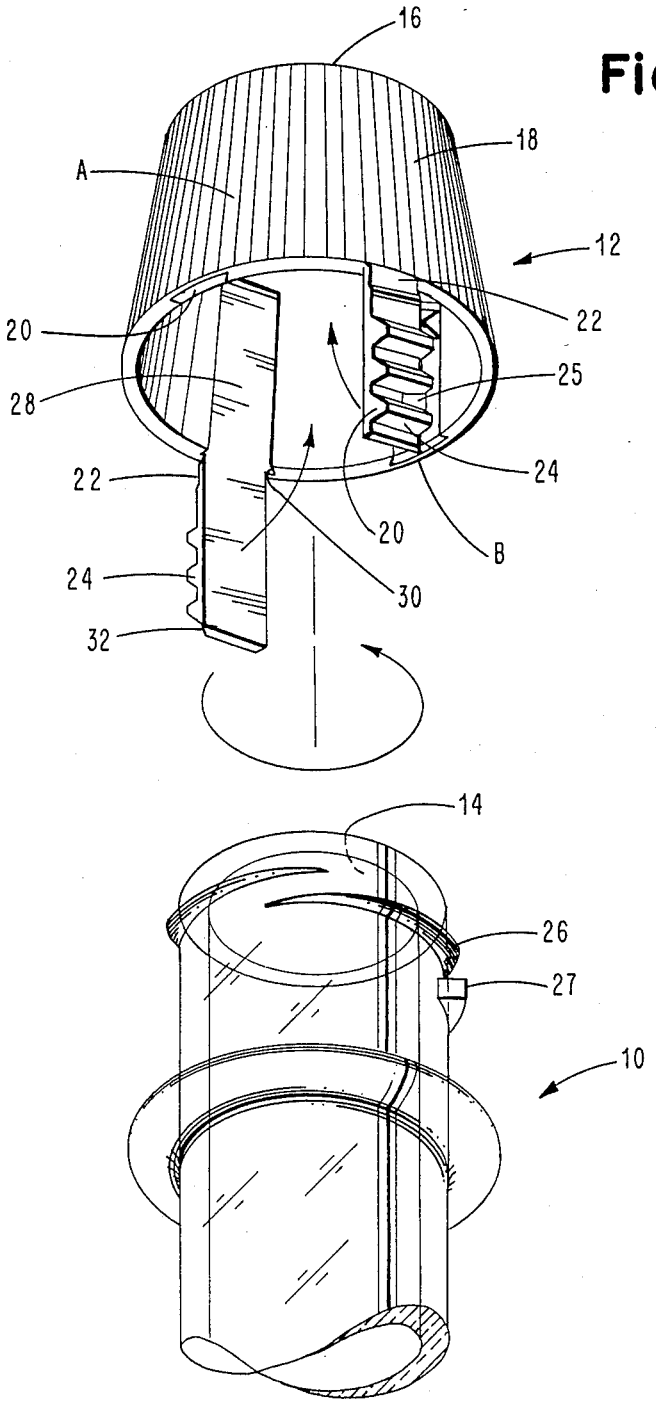
FIG. 1 is a perspective view of a cap and container neck constructed in accordance with the invention and showing the tabs pivotally secured by a living hinge to the skirt; two of the tabs extending out of the cap as formed, and two opposing tabs pivoted up into their operative position.

FIG. 2*a* is an enlarged fragmented cross-sectional view showing a tab being snapped into position in a cavity.

FIG. 2*b* is an enlarged fragmented cross-sectional view showing a tab in locked position in the cavity.

FIG. 3 is a longitudinal cross-sectional view of the attached cap and container; and FIG. 4 is a cross-sectional view of a mold for molding the cap and hinged tabs.

Reference will now be made in detail to the present preferred embodiment of the invention, an example of which is illustrated in the accompanying drawings.

DETAILED DESCRIPTION OF THE PREFERRED EMBODIMENT

Reference is now made to FIG. 1 showing a container neck 10 having a cap, generally designated by the reference numeral 12, constructed in accordance with the invention. The cap 12 is fitted over the container neck 10 to seal the container opening 14.

The cap 12 includes a top portion 16 and a depending skirt portion 18 for releasable attachment to the container neck 10. Hinged tabs 20 are integrally formed depending from the skirt portion 18. There are preferably four of the tabs 20 spaced 90° apart and permanently interconnected to the skirt portion 18 by integrally molded living hinges 22. The tabs 20 when formed may extend straight down from the skirt 18 as shown in this preferred embodiment, or radially out to the side. In either case, the tabs 20 are designed to be folded or pivoted toward the interior of the cap 12 to their operative position (note pivot arrows in FIG. 1). Also as shown in FIG. 1, the cap 12 is attached by clockwise turning motion after the tabs 20 are in position, as will be evident from the further description below.

The hinged tabs 20 are formed with connector means namely internal threads 24, adapted to engage mated external thread(s) 26 on the container neck 10 to provide for the secure attachment (compare FIG. 1 and FIG. 2). Although threads 24, 26 are shown in FIGS. 1–4 as the preferred embodiment; it is to be understood that snap-on beads or other known connecting mechanisms may be used in accordance with the broadest aspects of the invention.

The threads 24, 26 may have corresponding one-way locking lugs 25, 27 formed therein to engage and prevent inadvertant unscrewing of the cap 12. This feature also makes the cap child resistant. The locking lugs 25, 27 may be released and unscrewing permitted by applying pressure simultaneously over the two tabs 20 on opposite sides of cap 12 at points A, B (substantially spaced 90° in opposite directions around skirt 18).

To facilitate reapplying the cap 12, the locking lugs include ramps to allow the lug 25 to be cammed over the lug 27 during tightening of the cap. The height of the neck 14 is sufficient to provide a full sealing engagement with the inside of the top portion 16 when the two radial locking faces of the lugs 25, 27 are fully engaged.

The skirt portion 18 has cavities 28 adjacent to the hinged tabs 20 for receiving the tabs when pivoted into their operative position. The cavities 28 have converging sidewalls 30 for mating with matching converging edges 32 to provide secure engagement and retention. In a preferred embodiment of the invention, the receiving cavities 28 are substantially the same size and shape as the hinged tabs 20, thus allowing the hinged tabs 20 to snap into place in their seated position in the cavities 28. The inside surface of both the cavities 28 and the hinged tabs 20 are smooth since the hinged tabs 20 pivot 180° into the cavities 28. The spring memory of the hinges 22 continuously bias the tabs toward the interior of the cap to provide secure engagement of the edges 32 of the tabs 20 with the sidewalls 30.

As shown in FIG. 2*a*, the converging sidewalls 30 of cavities 28 are slightly expanded in the direction of the arrows D and the converging edges 32 of the tabs 20 are compressed as the tab 20 is forced into the cavity 28 (note action arrow F). When the tab 20 snaps into place as in FIG. 2*b*, the converging sidewalls 30 hold the tab 20 with forces in the direction of arrows C in opposition to the biasing by the living hinge 22. The tab 20 remains flexible in the cavity 28 due to a slight clearance behind the tab allowing slight outward movement. This flexing action can accommodate slight irregularities in the thread 26, thus improving the smoothness with which the cap 12 can be screwed on and off of the container neck 10. This movement also serves to accommodate camming of the locking lug 25 into position as the corresponding lug 27 on the container neck is engaged.

The molding of the cap 12 requires a cavity mold 34 and a core mold 36 (see FIG. 4). The living hinge 22 is formed by a restricted annular cavity 37 between the upper and lower cavity sections for the skirt and the tabs, respectively. The threads 24 are formed on the exterior of the tabs 20 by spiral indentation 38 on the cavity mold 34 in the lower section. The projections 39 on the core mold 36 form the cavities 28 into which the tabs are pivoted and seated.

To form the cap 12, flowable plastic is injected into the upper cavity section through a valve 40. The plastic flows around the core mold 36 with the projections 39 forming the four spaced cavities 28. Next, the plastic moves through the restricted annular cavity 37 forming the living hinges 22, and then down into the lower section with spiral indentation 38 to form the four tabs 20 with the threads 24 (compare mold of FIG. 4 with cap 12 in FIG. 1).

Significantly, all of the interior surfaces of the cap 12, cavities 28 and the back of the tabs 20 are smooth, so that the core mold 36 can simply be withdrawn along a straight path (see action arrow P in FIG. 4). This advantageously eliminates the pulling of undercuts or unscrewing of core molds required by the prior art arrangements.

The hinged tabs 20 can be easily folded inwardly from the cavity mold 34 after removal of the core mold 36 allowing the cap 12 to be dropped freely or otherwise easily removed from the cavity mold 34. After the cap 12 is removed, the tabs 20 are simply folded along hinges 22 into the cap 12. The folding movement is through 180° if the tabs are formed to extend straight down; or through 270° if the tabs extend outwardly from the cap (not shown). The tabs 20 are secured by snapping into position in the cavities 28 where the converging edges 32 of the tabs are interlocked with the converging sidewalls 30.

In summary, the container cap 12 of the present invention is easier and more economical to form and, thus, provides signficant advantages over the prior art container caps. Specifically, the cap 12 may be constructed with the tabs 20 upon which the threads 24 are formed. Initially, the tabs are positioned outside the cap to facilitate the forming process. The cavities 28 on the inside receive the tabs 20 after being pivoted inwardly on the living hinge 22. The mating converging sidewalls 30 and edges 32 allow desirable snap action locking of the tabs 20 into position. With this arrangement wherein all of the interior surfaces of the skirt portion 18 are smooth, the requirement of the prior art for pulling undercut molds or unscrewing core molds is advantageously eliminated. The tabs 20 remain flexible in their respective cavity 28 and biased outwardly by their hinge 22 to assure full positive connection with the container but capable of flexing action to prevent binding and to allow easier camming of the locking lug 25 into position.

The foregoing description of a preferred embodiment of the invention has been presented for purposes of illustration and description. It is not intended to be exhaustive or to limit the invention to the precise form disclosed. Obviously, many modifications and variations of the present invention are possible in light of the above teachings. For example, if desired, longitudinal guide ribs (not shown) parallel to the tabs 20 can be provided inside the skirt portion 18 to provide further stabilty to the cap 12 on the container neck 10. The embodiment was chosen and described to provide the best illustration of the principles of the invention and its practical application to thereby enable one of ordinary skill in the art to utilize the invention in various modifications as are suited to the particular use contemplated. It is intended that the scope of the invention be defined by the claims appended hereto.

I claim:

1. A cap for sealing a container comprising:

a top portion and a depending skirt portion;

tab means integrally formed with said depending skirt;

said tab means having hinge means connecting one end thereof to said depending skirt portion;

said hinged tab means having connector means adapted for releasable attachment to said container; and said skirt portion having a cavity formed to mate with said hinged tab means adjacent said hinge means, said cavity receiving said hinged tab means when said tab means is folded inwardly to position said connector means for attachment to said container.

2. A cap for sealing a container as recited in claim 1, wherein said cavity has converging sidewalls.

3. A cap for sealing a container as recited in claim 2, wherein said hinged tab means have converging edges for secure engagement with said converging sidewalls of said cavity.

4. A cap for sealing a container as recited in claim 3, wherein said tab means snap fits in the corresponding cavity.

5. A cap for sealing a container as recited in claim 1, wherein said tab means when positioned in said cavity is biased away from said cavity by said hinge means.

6. A cap for sealing a container as recited in claim 5, wherein said hinge means is integral with said skirt portion and said tab means to form a living hinge.

7. A cap for sealing a container as recited in claim 5, wherein said tab means is flexible through said hinge means for movement in the cavity.

8. A cap for sealing a container as recited in claim 1, wherein is provided lug means on said tab means to engage said container and lock said cap in position.

9. A cap for sealing a container as recited in claim 1, wherein said tab means depends from said skirt portion and substantially folds through 180° from the depending position to the operative position in said cavity.

10. A combination of a container and a cap comprising:

a top portion and depending skirt portion of said cap for releasable attachment to said container about an opening in the container;

tab means being integrally provided with said depending skirt portion;

said tab means having hinge means connecting one end thereof to said depending skirt portion;

said hinged tab means having connector means adapted for releasable attachment to said container;

said container having connector means to mate with said connector means of said hinged tab means; and said skirt portion having a cavity formed to mate with said hinged tab means adjacent to said hinge means, said cavity receiving said hinged tab means when said tab means is folded inwardly to position said connector means for attachment to said container.

11. A combination of a container and a cap as recited in claim 10, wherein said cavity has converging sidewalls.

12. A combination of a container and a cap as recited in claim 11, wherein said hinged tab means have converging edges for secure engagement with said converging sidewalls of said cavity.

* * * * *